US005953040A

United States Patent [19]

Barton et al.

[11] Patent Number: 5,953,040

[45] Date of Patent: Sep. 14, 1999

[54] FIELD-REPLACEABLE OPTICAL ASSEMBLIES FOR DIGITAL PRINTERS

[75] Inventors: James T. Barton, Fairport; James M. Warner, Brockport; Svetlana Reznik, Rochester, all of N.Y.

[73] Assignee: Eastman Kodak Company, Rochester, N.Y.

[21] Appl. No.: 08/794,225

[22] Filed: Jan. 30, 1997

[51] Int. Cl.[6] ..... G11B 7/08

[52] U.S. Cl. ..... 347/241; 347/256; 347/257; 360/104

[58] Field of Search ..... 347/238, 241, 347/242, 245, 257, 263, 264; 360/104, 129; 206/494

[56] References Cited

U.S. PATENT DOCUMENTS 5,034,836 7/1991 DeMarti, Jr. et al. ..... 360/104

5,136,558 8/1992 Getreuer et al. ..... 206/494

5,642,149 6/1997 Palum ..... 347/241

*Primary Examiner*—N. Le

*Assistant Examiner*—Hai C. Pham

*Attorney, Agent, or Firm*—Peyton C. Watkins

[57] ABSTRACT

A printing apparatus having a fixed focal point for a recording medium to which the printing apparatus writes, the apparatus comprises a rotor; an intensity-modulated light source adapted to emit a light beam along an optical path; a platform having three variably positioned ball feet to which platform the light source is fixed for maintaining the positional relationship of the light source in relation to the focal point; a plate having three grooves attached to the printing apparatus which cooperatively receives the ball feet; and a housing that receives the plate and platform and cooperatively attaches to the rotatable rotor to move the light source for scanning the light beam along the recording medium, for permitting removal and replacement of the light source in a precise fashion.

13 Claims, 10 Drawing Sheets

FIELD-REPLACEABLE OPTICAL ASSEMBLIES FOR DIGITAL PRINTERS

CROSS-REFERENCE TO RELATED APPLICATIONS

Reference is made to commonly assigned, co-pending U.S. Pat. No. 5,392,662, issued Feb. 28, 1995 entitled LEADSCREW COUPLER, by Jadrich at al.; Ser. No. 08/371,241, entitled DIGITAL PRINTER WITH SUPPORT SHOE AND TRANSLATABLE MEDIA GUIDE MEMBER THEREIN filed by M. Bridges on Jan. 11, 1995; Ser. No. 08/418,732, entitled LENS ADJUSTMENT ASSEMBLY FOR ELECTRONIC DIGITAL IMAGING APPARATUS, filed by M. Bridges on Apr. 7, 1995.

FIELD OF THE INVENTION

This invention relates generally to the field of electronic digital imaging apparatuses of the type having insertable focused light sources as relayed by a projection optics assembly and, more particularly, to such apparatuses for accurately aligning and maintaining position of the light sources with respect to the projection optics assembly.

RELATED ART

Electronic digital imaging, such as for example in either or both copiers and printers, is accomplished by modulating the intensity of a light beam that forms a writing spot on a photosensitive media as the light beam moves relative to the photosensitive media. One type of electronic signal imager uses a modulated array of light emitting diodes (LED's) positioned on a write head assembly disposed on a rotor which is simultaneously rotated about a fixed axis and linearly translated past stationary photosensitive recording media mounted on the inner surface of a cylindrical support to form a plurality of writing spots moving across the photosensitive material in a fast scan direction and in a slow scan direction, such as disclosed in commonly assigned, co-pending U.S. patent application Ser. No. 08/371,241, entitled DIGITAL PRINTER WITH SUPPORT SHOE AND TRANSLATABLE MEDIA GUIDE MEMBER THEREIN filed by M. Bridges on Jan. 11, 1995.

Imagers such as disclosed in the Bridges application must be factory-focused onto a predicted media surface. It may be desirable from time-to-time to adjust the focus of the optical system such as to accommodate media of different thicknesses. Prior art discloses projection optics that enables the use of photosensitive media of multiple thicknesses in a rotary printer of the type described by Bridges. The projection optics can be re-focused relative to the media support to enable the use of photosensitive media of multiple thicknesses while using the same lens assembly.

When using imagers such as disclosed by Bridges and Kiesow, the optics must remain focused under high rotational gravitational forces, and yet be easily re-focused in the field. Dismounting the lens during LED array changes causes a loss of focus, so provision must also be made for easy and repeatable replacement of the LED array. The optical elements must be lightweight to minimize inertia because they are mounted on a spinning rotor. Commonly assigned, co-pending U.S. patent application Ser. No. 08/418,732, entitled LENS ADJUSTMENT ASSEMBLY FOR ELECTRONIC DIGITAL IMAGING APPARATUS, filed by M. Bridges on Apr. 7, 1995, discloses a flexural adjustment mechanism that enables the LED array and the projection optics to be adjusted as a unit relative to the media plane. In this approach, the entire LED and projection optics assemblies are removed from the print engine; thereupon the LED assembly is removed and replaced, and the completed assembly is re-installed in the print engine. Refocusing of the projection optics assembly is required using the above flexural adjustment mechanism.

The projection optics assembly utilizes a pair of aspheric opposed reflection surfaces to simultaneous transmit three distinct colors of light without chromatic distortion. The high numerical aperture associated with this imaging system severely restricts its depth of field, requiring accurate placement of a set of in-plane apertured LED windows. For proper transmission of a two-dimensional image of the LED array, it is important to maintain the X-Y plane (where X and Y define orthogonal directions within the plane of the array) as well as the lateral position within that plane. To achieve consistent image quality, a narrow set of coordinates have been specified for the LED assembly relative to the projection optics assembly. These include in-plane X and Y positioning of the LED array, tip and tilt rotations $\theta_x$ and $\theta_y$ of the LED array about the X-Y plane, rotation $\theta_z$ of the X-Y LED array about the Z-axis (normal to the X-Y plane), and finally the position Z along the focal axis. This describes and restricts all six degrees of freedom for the LED assembly. The LED assembly is said to be exactly constrained, meaning to fix each of the three directions X, Y, and Z, and each of the three possible rotations about these directions (all six possible degrees of freedom) without over constraining any one of the degrees of freedom, thereby avoiding any induced stress at the interface.

The LEDs are placed behind a quartz aperture array plate, and the image of the aperture is focused on the writing plane. This image of the aperture is not at the aperture itself, but rather exists some distance from the aperture within the quartz aperture array plate. A requirement of such systems is that the aperture be imaged, rather than the LEDs themselves. The position of the image of the aperture from the LED mounting surface is dependent upon dimensional tolerances of the mounting components. The tolerance variations associated with the component parts and their resultant assembly causes unacceptable variations in the position of the LED plane to be imaged by the projection optical system, leading to focusing difficulties in the event of light source replacement.

Consequently, a need exists for improvements in the construction and mode of operating digital printers so as to overcome the above-described drawbacks.

SUMMARY OF THE INVENTION

The present invention is directed to overcoming one or more of the problems set forth above. Briefly summarized, according to one aspect of the invention, the invention resides in a printing apparatus having a fixed focal point for a recording medium to which the printing apparatus writes, the apparatus comprising: (a) a rotor; (b) an intensity-modulated light source adapted to emit a light beam along an optical path; (c) a platform having three variably positioned ball feet to which said platform the light source is fixed for maintaining the positional relationship of said light source in relation to the focal point; (d) a plate having three grooves attached to the printing apparatus which cooperatively receives the ball feet; and (e) a housing that receives said plate and platform and cooperatively attaches to the rotatable rotor to move the light source for scanning the light beam along the recording medium, for permitting removal and replacement of the light source in a precise fashion.

It is an object of the present invention to provide a print engine having a platform to which an LED can be attached, thus providing a precision LED assembly which can preferably be replaced without removing the projection optics assembly of an imaging assembly from the print engine.

It is another object of the present invention to provide an alignment means which requires no special installation tools, and yet preserves established focal settings.

It is another object of the present invention to provide a procedure for testing LED assemblies to insure that they conform to a common interface datum structure, even though variations can be introduced through part tolerances, assembly methods, and/or locating structures.

It is another object of the present invention to provide a compensation feature for thermal expansion growth, such that alignment datum structures remain unaffected in rotational and translational directions.

It is yet another object of the present invention to provide a LED assembly which can withstand large sideload de-accelerations, as in the case of a paper jam causing abrupt stoppage of the spinning rotor arm, and which LED assembly can automatically re-align itself to a proper focal position without operator intervention.

It is another object of the present invention to provide a guiding means for insertion, removal, and orientation of an LED assembly into proper position.

It is yet another object of the present invention to provide exact-constraint contact with the projection optics assembly, and provide a means and method of maintaining alignment to the projection optics assembly and convenient removal in cases requiring future replacement.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

PREFERRED EMBODIMENT OF THE INVENTION

Figure 1A:
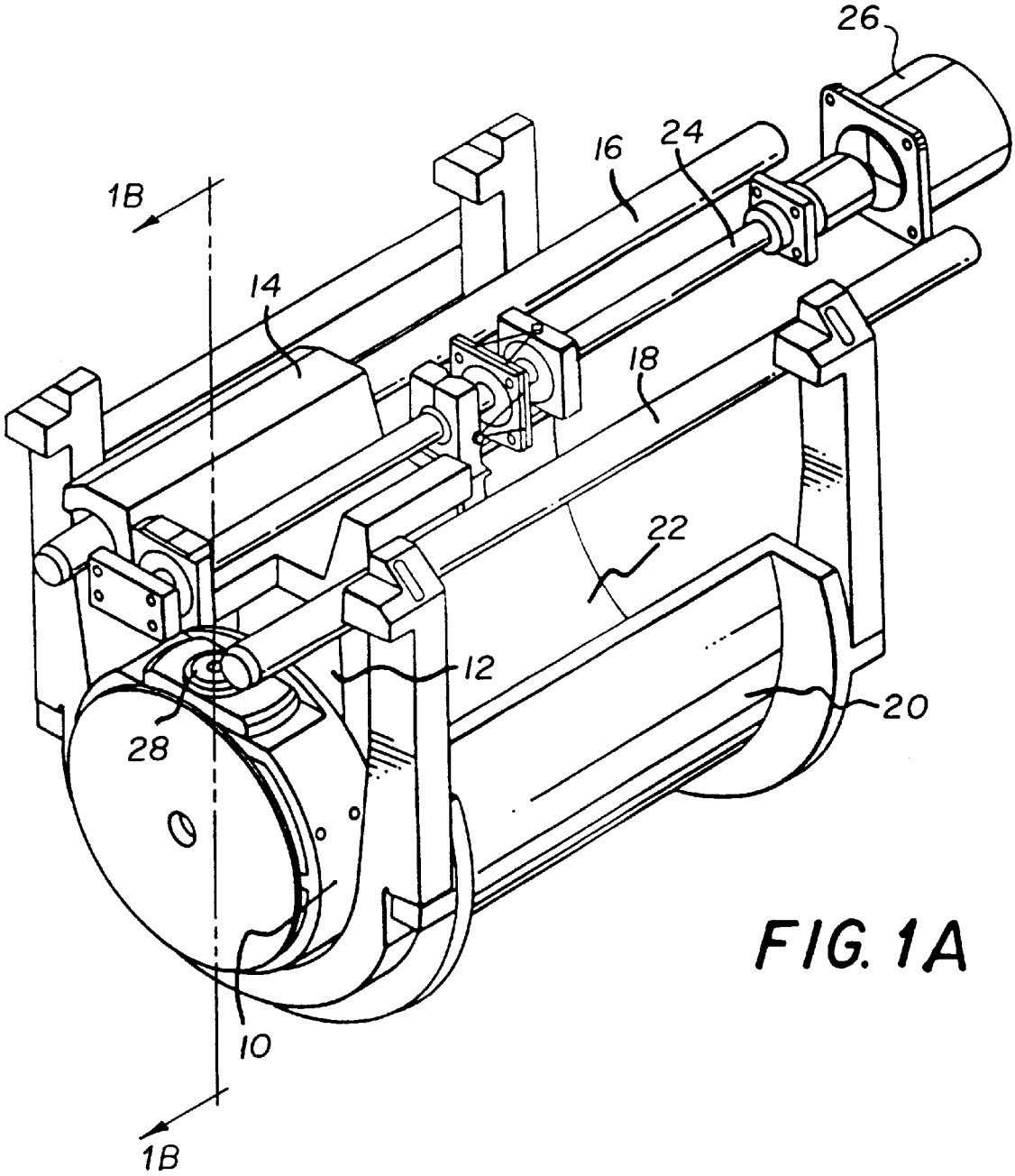
FIG. 1A shows a rotary printing system employing an LED light source and attached projection optics.
Figure 1B:
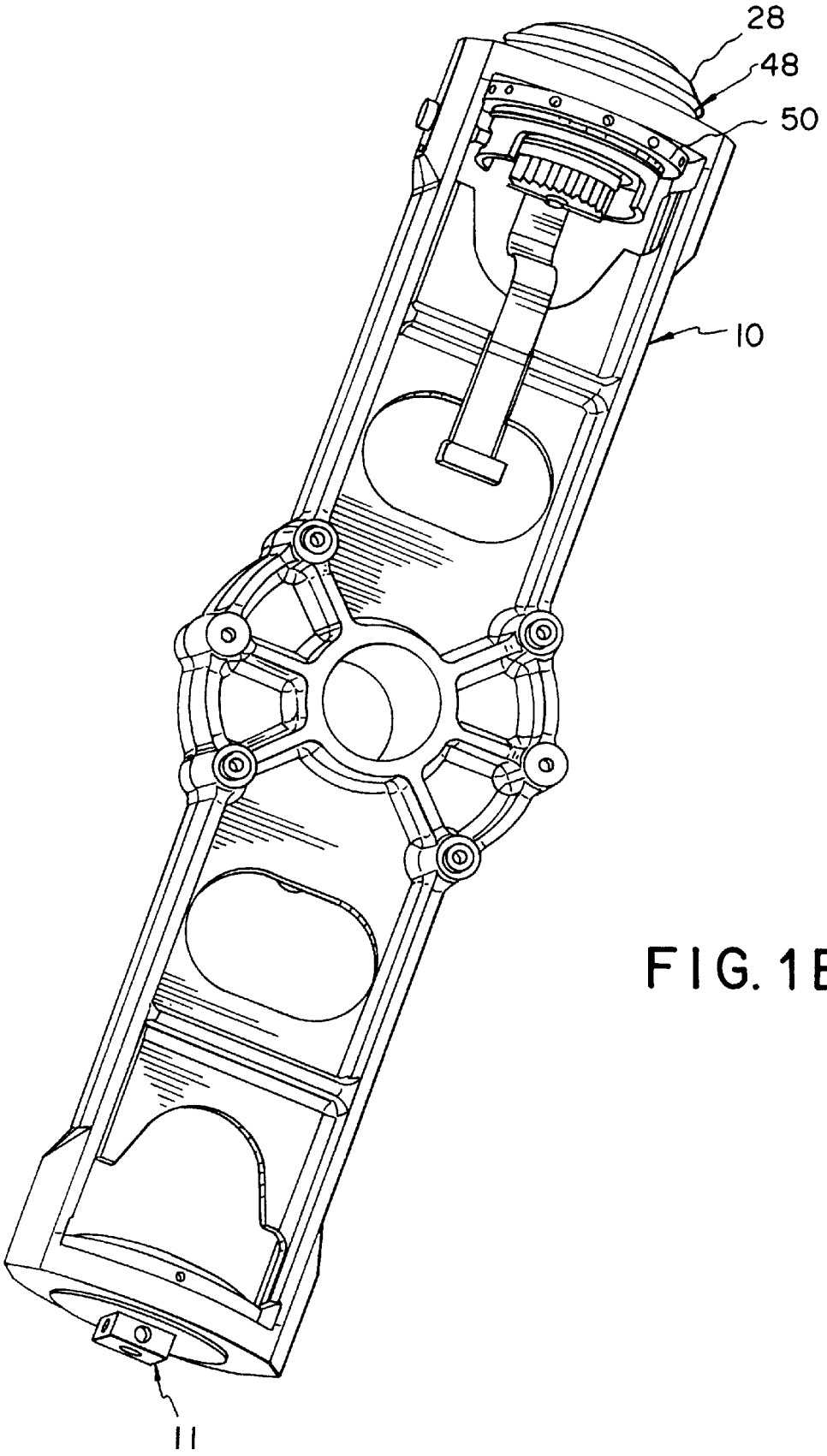
FIG. 1B shows an imaging assembly and attachment means supported by a rotor arm, and counterbalanced at its opposing radial end.

A rotary printing system employing an adjustable-position imaging assembly is illustrated in FIG. 1A and 1B, and includes a rotor 10 coupled to a drive motor, not shown, supported by a rotor support member 12 which hangs from a carriage assembly 14 which is supported for movement along a pair of guide rods 16 and 18. The rotor is arranged to spin and move axially within a cylindrical support 20 which is adapted to receive a sheet of photosensitive material on the inner surface 22 thereof. Rotor 10 is attached to a linear translation assembly comprising rotor support member 12, carriage assembly 14, and a lead screw 24 driven by a stepper motor 26. The rotor is simultaneously rotated by the drive motor in a fast scan direction and is translated past the cylindrical support in the slow scan direction (axially) by the stepper motor and lead screw 24, thereby achieving a raster scan pattern on the photosensitive media held within the support.

An imaging assembly 28 is mounted in rotor 10 and comprises a plurality of mono-color light sources such as an array of LED's and a projection optics assembly. Counter weight 11 is positioned at the opposing end of rotor 10 to provide rotational balance. An LED assembly is located within the body of rotor 10 with an LED aperture output surface located in a plane perpendicular to the optical axis of the projection optics assembly. The projection optics assembly is arranged to simultaneously image (focus) all of the LED's in the array onto a surface located in close proximity above the outer surface of the rotor, and more particularly, onto the inner surface of the photosensitive material held by cylindrical support 20. A single projection optics assembly thereby images the plurality of LEDs onto a photosensitive material as a plurality of individual images which constitute the writing beams that expose the image pixels. Additional details of the LED array and the generation of pixel control signals can be found in U. S. patent application Ser. No. 08/123,839 entitled METHOD AND APPARATUS FOR EXPOSING PHOTOSENSITIVE MEDIA WITH MULTIPLE LIGHT SOURCES filed by Smith et al. on Sep. 20, 1993.

Figure 2:
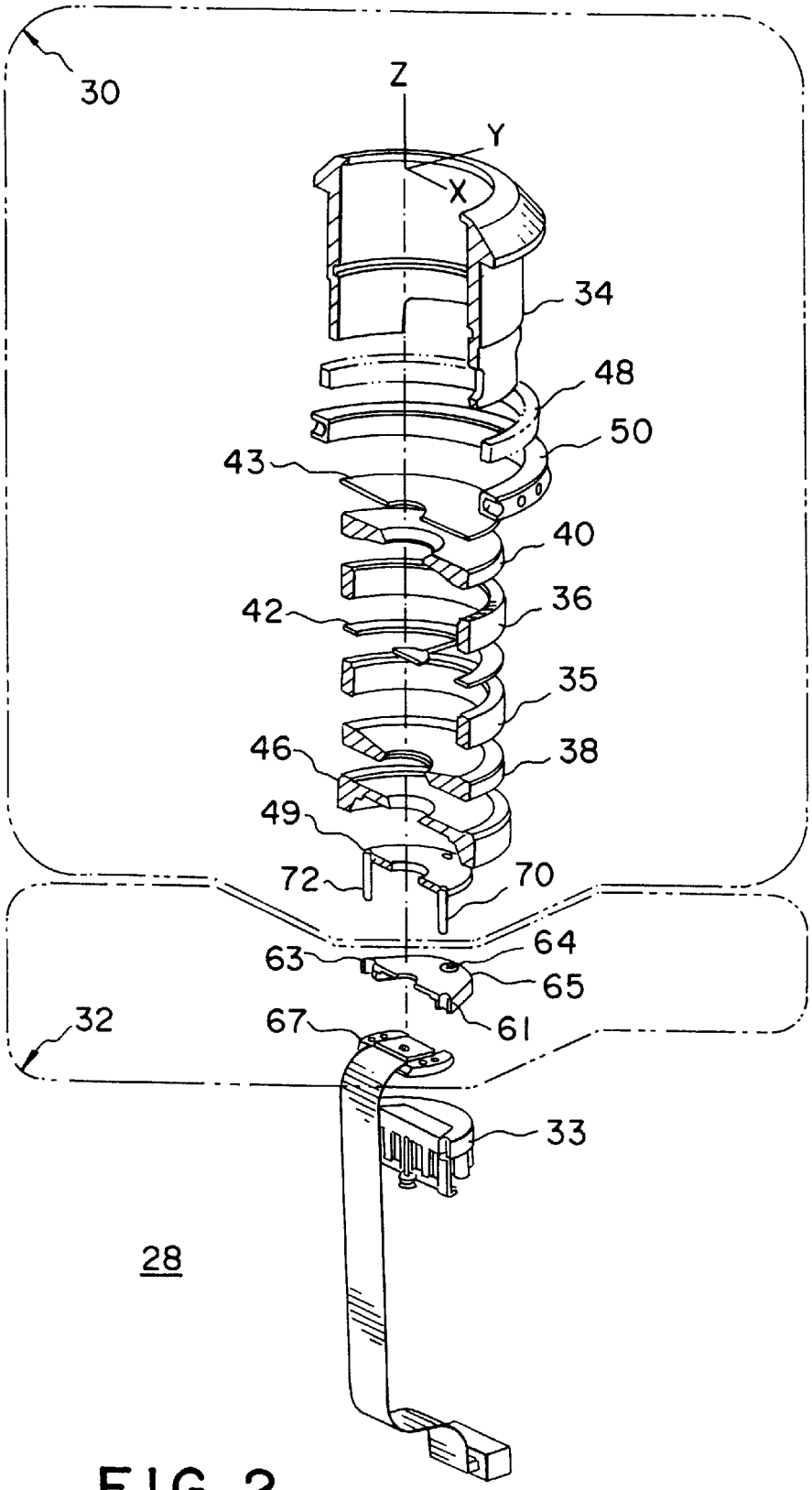
FIG. 2 shows an imaging assembly which includes a plurality of LED light sources, a projection optics assembly which collects and transmits the patterned light sources to the photosensitive media plane, and a retainer mechanism for heat-management and proper alignment.

Referring to FIG. 2, imaging assembly 28 includes a projection optics assembly 30, an LED assembly 32, and a retainer assembly 33. The assemblies are coupled to produce a digital writing system capable of selectively exposing 12 separate but adjacent regions of media surface. Each imaging assembly is positioned to optimize image quality writing performance relative to the media riding on the inner surface 22 of cylindrical support 20. Position of imaging assembly 28 relative to rotor arm 10 and inner surface 22 is maintained by a threaded barrel 34 containing the projection optics, and held in place by a wave washer 48 and a locking nut 50. Barrel 34 receives an upper mirror 40 and a lower mirror 38 separated by a pair of mirror spacers 35 and 36. A blocking aperture 42 fits between the spacers 35 and 36 such that it is positioned midway between the two opposing mirrors 38 and 40. An exit aperture 43 is positioned in contact with the non-reflecting side of mirror 40 to control stray light emission. Once imaging assembly 28 is set for correct focal distance, namely such that the focal point is at the surface of the recording medium, it does not need to be reset, even in the case where the LED assembly is removed and replaced. Any other LED assembly cooperatively fitting with projection optics assembly 30 will, by exact constraint design and mounting techniques, according to the present invention, be located in the same spatial position to within tight tolerance limits.

Figure 3:
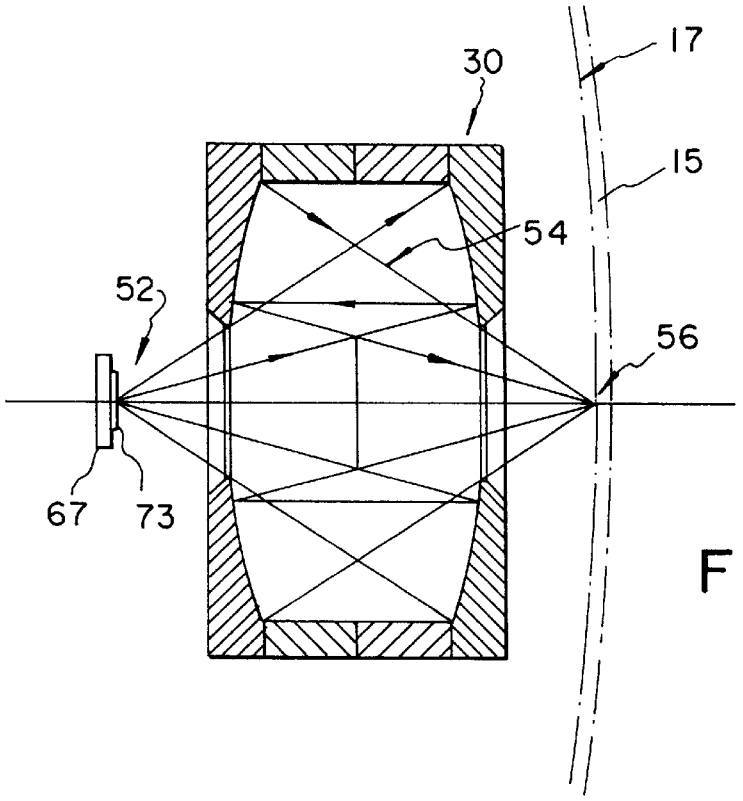
FIG. 3 shows the optical portion of the imaging assembly, including the object and image locations, the optical ray path through the assembly, the central obscuration, and the spacer elements separating the opposing aspheric mirror surfaces.

Referring to FIG. 3, projection optics assembly 30 receives an input image at its rear focal conjugate 52 and transmits it via a path 54 to the front focal conjugate, or focal point 56 of the projection optics assembly. The image of the LEDs as seen through an aperture array plate 73 is positioned at rear focal conjugate 52, and the writing surface 17 of photosensitive media 15 is placed at front focal conjugate 56.

Figure 4:
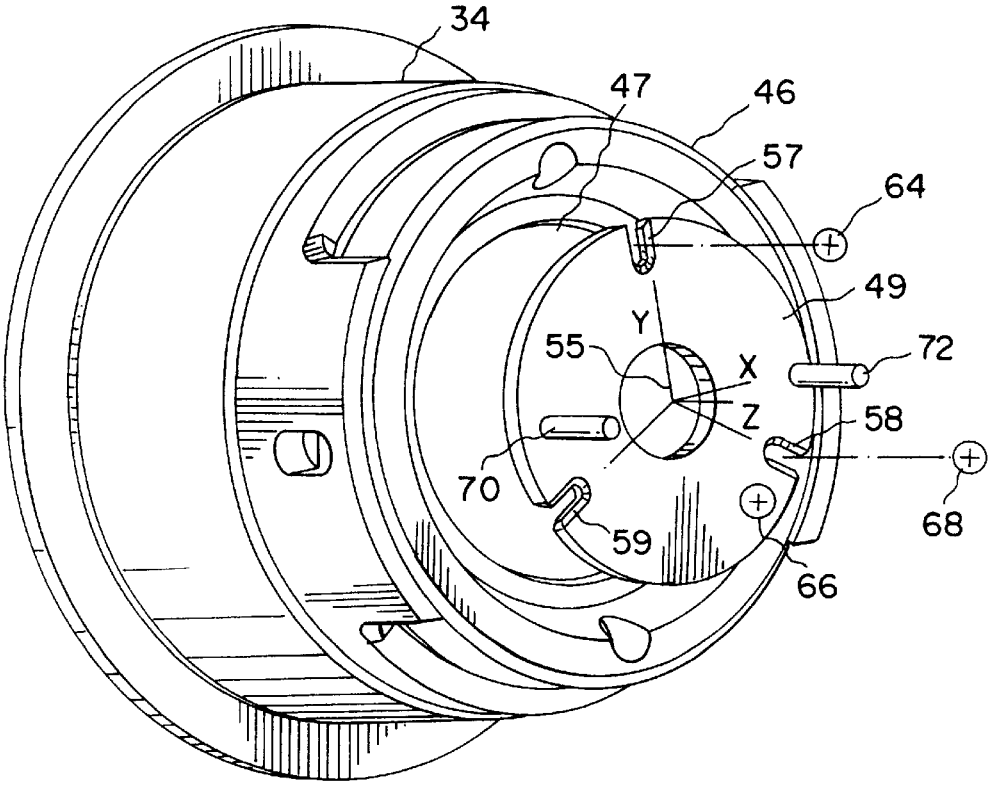
FIG. 4 shows the jam nut which holds the optical elements in place, the slotted-plate assembly which fits into a recessed pocket in the surface of the jam nut, and the three balls from the LED assembly which interface with the three radial grooves in the slotted-plate.

Referring to FIG. 4, threaded barrel 34 and its projection optics contents are held in compression by jam nut 46. The same jam nut has a circular recess 47 cut into the face opposite the mirror assembly. Recess 47 holds a circular slotted plate assembly consisting of a plate 49, flush-mounted orthogonal pins 70 and 72, and three radial, slots 57, 58, and 59 arranged on 120° centers. Each of the slots is chamfered on the plate side which cooperatively receives the balls 64, 66, and 68 from the 3-ball platform 65 in FIG. 5. The two pins serve three separate functions as retainers for side motions of the LED assembly, guide pins for insertion and removal of the LED assembly to the optical assembly, and magnetic attachment points for the retainer assembly.

Figure 5:
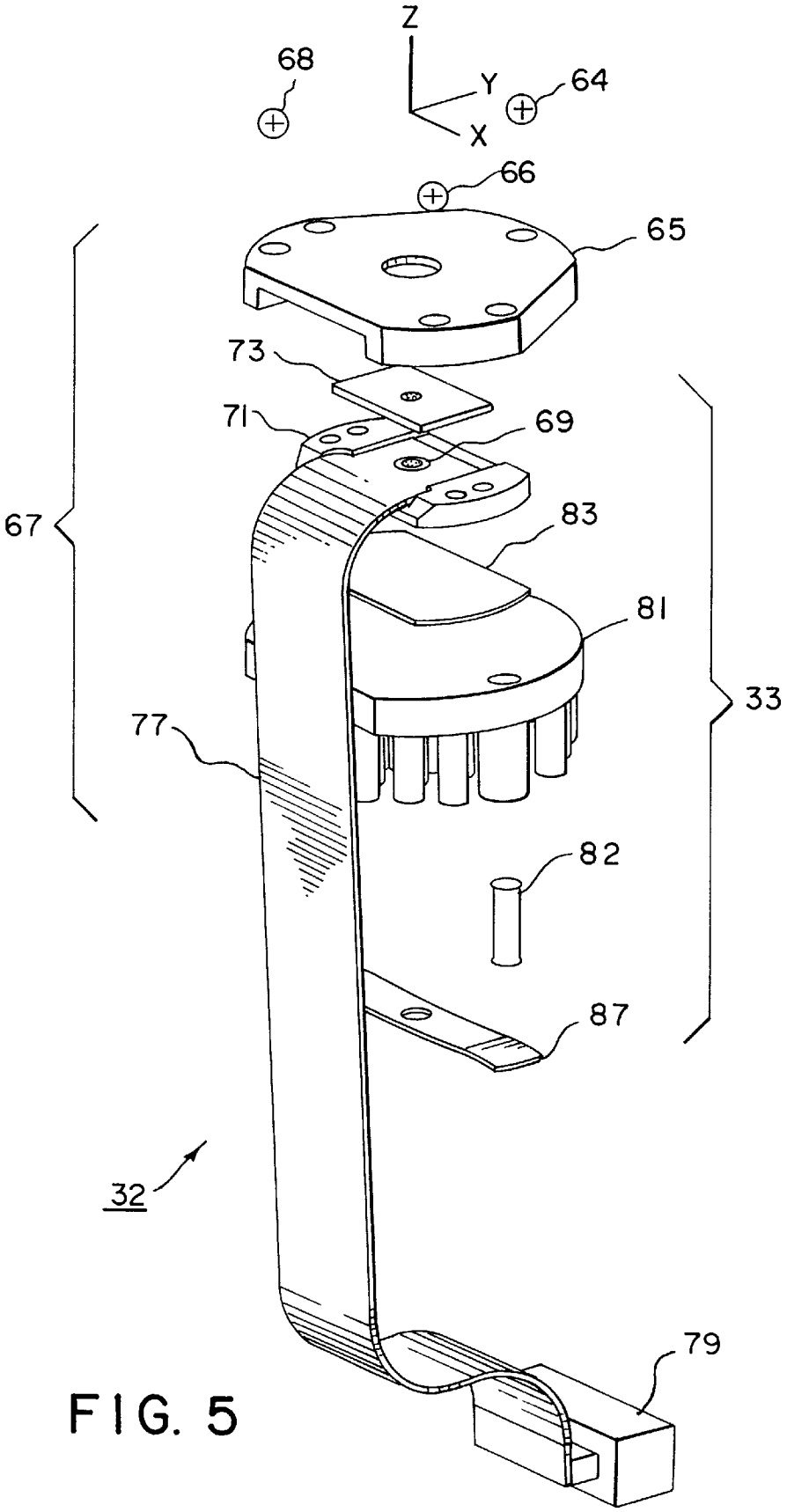
FIG. 5 shows the LED assembly, consisting of the light source module, the 3-ball platform and associated balls, and the retainer assembly with the magnetic flexural holding device.
Figure 6:
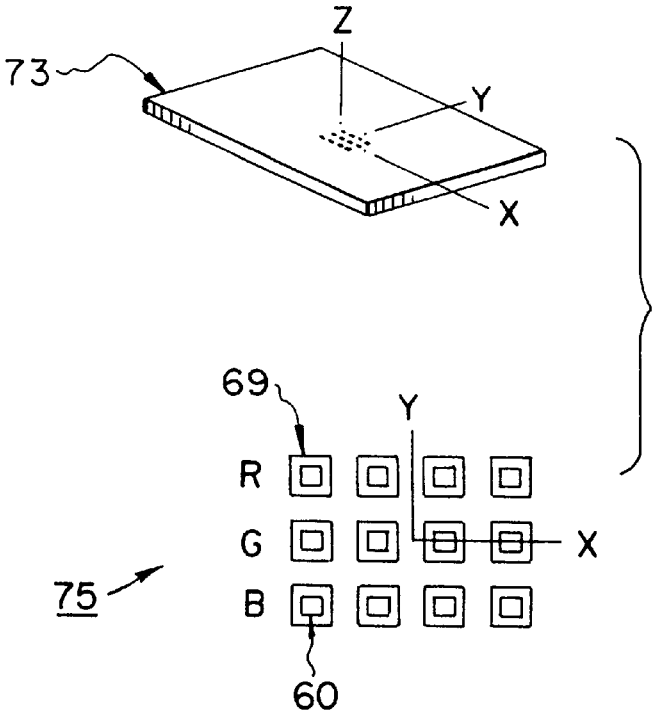
FIG. 6 is an enlarged view of the aperture array plate, and the arrangement of LEDs of differing wavelengths behind the individual apertures.

Referring to FIGS. 2 and 5, the LED assembly 32 consists of a light source module 67 which includes twelve individual LED dies 69 attached to a baseplate 71 and covered by a quartz aperture array plate 73. The quartz plate is coated on one side with an opaque black chrome, and has twelve transparent square openings 60 arranged in a 3×4 matrix 75, as shown in FIG. 6. Each transparent window is slightly smaller than the LED die directly beneath and aligned to it, thus giving the appearance of a fully filled window from the non-coated side of the plate. Referring back to FIG. 5, the light source module 67 consisting of the baseplate, the LED dies, an associated flex circuit address leads 77, a connector 79, and the aperture array plate 73, are assembled as a unit and placed in the 3-ball platform 65, with the LED illumination directed through the central hole in platform 65 to illuminate the region beyond the 3-ball platform.

Figure 7:
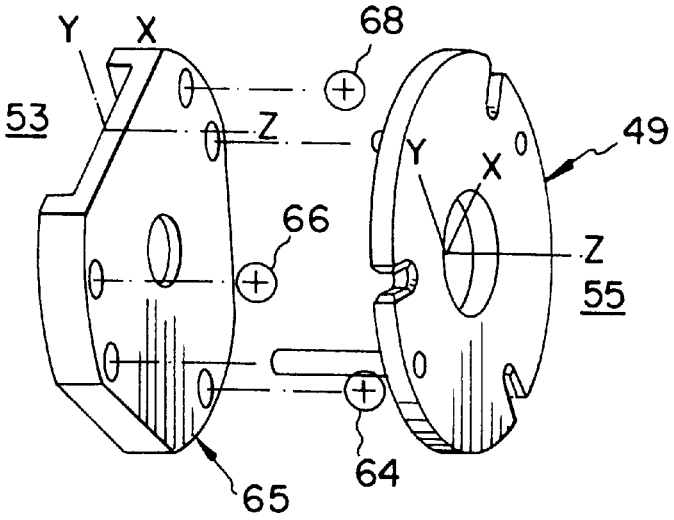
FIG. 7 shows the relationship between the 3-ball platform, the three captured balls, and the slotted-plate assembly.

Referring now to FIG. 7, the 3-ball platform 65 has three holes arranged on 120° radials from its center, and a steel ball fits loosely within each hole. The balls are positioned within the holes such that when cooperatively aligned with slotted-plate 49, plane 53 of the 3-ball platform is parallel to the plane 55 of the slotted-plate. Furthermore, the ball positions are such that the optical position of the LEDs as seen through the aperture array plate is a constant distance from the surface of the slotted-plate, and in fact is positioned at the nominal conjugate point of the projection optics as shown in FIG. 3. Light source module 67 (FIG. 5) fits into a recessed opening in the 3-ball platform, and contacts that platform on a raised shoulder support, such that the aperture array plate 73 does not make any mechanical contact with any surface on the 3-ball platform. The combination of the light source module with the 3-ball platform and the three positioned balls is known as the LED assembly 32, as seen in FIGS. 2 and 5.

Figure 8:
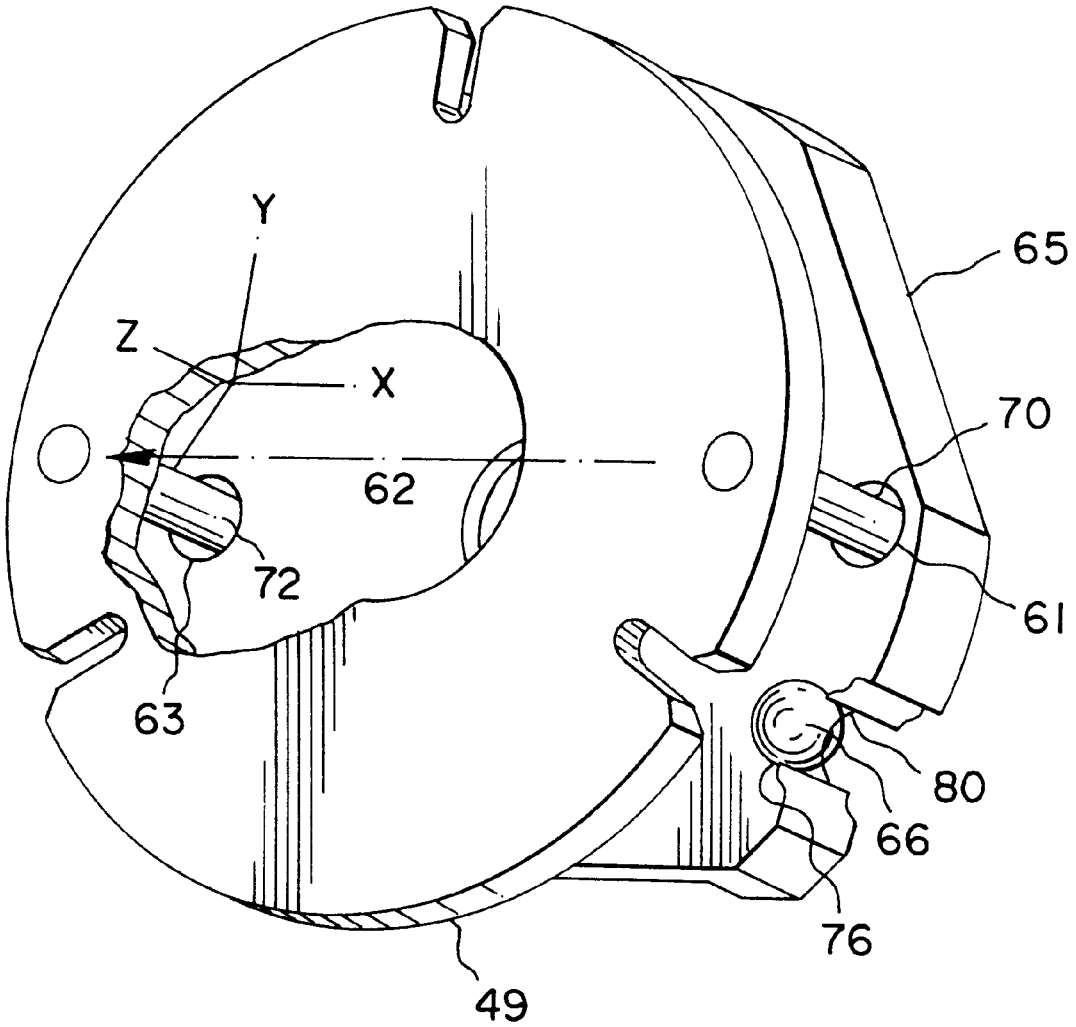
FIG. 8 shows the 3-ball platform, a ball captured by one of the three holes in same plate, the clearance relationship between the ball surface and the sidewalls of the hole, and an adhesive agent holding a second ball in proper position.

FIG. 8 shows a cut away view of fit between ball 66 and hole 76. Note that the ball is smaller than the hole, typically by 75 to 150 microns, such that the ball can freely move large amounts in the (Z) direction, and small amounts in the (X) and (Y) directions of plane (XY). This feature allows the three balls to be accurately placed using a master tool (not shown), so that they always carry the same predetermined planar and radial location geometry, especially in the likely event that the true position of the three holes is not the same from one 3-ball platform to the next.

Once properly placed within their respective holes, the balls are glued or otherwise bonded to the sidewall of the holes by application of an adhesive agent 80. The adhesive agent takes up any positional differences which may exist between true design position (as defined by a master tool) and actual position of hole bore centerline. The ability to position the three balls such that focal and positional performance is standardized from one LED assembly to the next leads to positional accuracy and unit to unit repeatability, and further to use this concept to produce field-replaceable assemblies.

The 3-ball platform 65 has two additional holes 61 and 63 which act as clearance holes, and allow pins 70 and 72 protruding from the slotted-plate 49 to pass through the 3-ball platform and out its rear surface. The interaction of pin 70 with clearance hole 61, and cooperatively pin 72 with clearance hole 63, serves to provide a loose restraint for the LED assembly tangential motion 62 relative to the projection optics assembly in the event of a paper jam. This same loose restraint feature acts as a rough alignment guide when locating (installing) the LED assembly relative to the projection optics assembly, guiding and rotationally orientating the ball feet of the 3-ball platform to the cooperative radial grooves of the slotted-plate. The nominal clearance between the pin and the sidewall of the hole is designed to be less than half the radius of the ball, so that in the event of a tangential force which dislodges any or all balls from their respective grooves, a normal force applied to the rear of the LED assembly will cause the ball feet to fall back into their respective grooves. Thus, in the event of a paper jam which causes loss of alignment of LED assembly to projection optics assembly, the LED assembly is able to self-correct its position, and to immediately continue its exposure operation in a fully focused condition.

Figure 9:
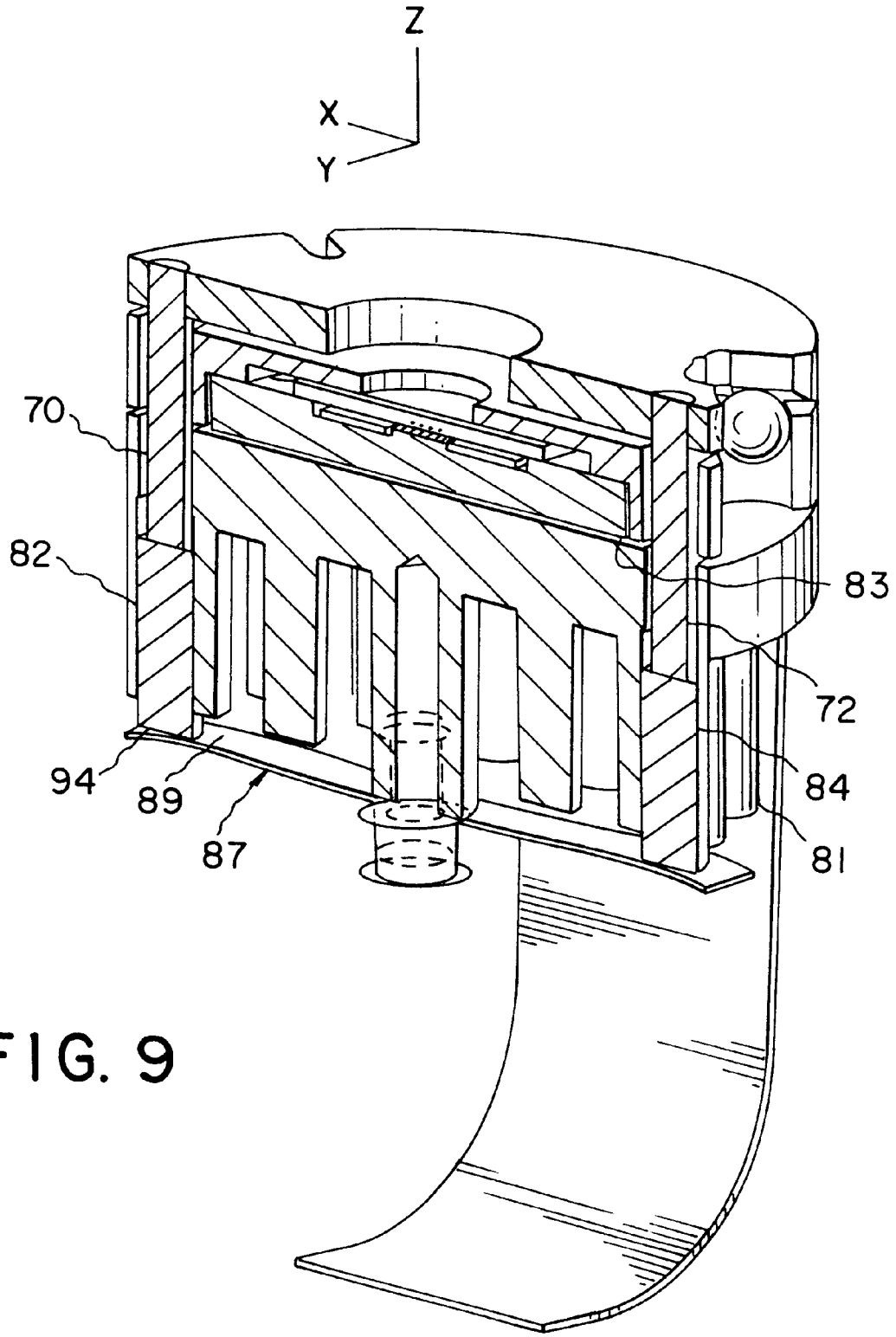
FIG. 9 is a cut away view of the retainer assembly in relation to the LED assembly and the slotted-plate assembly.

FIG. 9 is a sectional view showing the portion of the projection optics assembly which cooperatively receives the ball feet protruding from the 3-ball platform that is part of the LED assembly. It also shows the retainer assembly 33 (Ref. FIG. 5) in an engaged position, applying a normal force to the LED substrate that is part of the light source module 67. The retainer assembly serves multiple functions of heat removal through its finned construction 81 and 20 use of thermal transfer tape 83; controlled force loading through the use of ferrous and non-ferrous material selection coupled with a closed magnetic circuit 85 (shown in further detail in FIG. 10), and ease of insertion and removal by use of the exact constraint 3-ball mount and magnetic lock features. Pins 70 and 72 serve as guides for blind installation of the combined LED assembly and retainer assembly, as well as hard magnetic stops for the cylindrical magnets 82 and 84 which travel in clearance bores within the non-ferrous structure of the retainer assembly. A slightly curved flexure 87 serves as a magnetic keeper element to prevent partial de-magnetization of the twin magnets by completing a closed magnetic circuit. The same flexure provides a force vector which opposes magnetic coupling of flexure surface 89 with pin surface 94, resulting in a position-tolerant device which positively couples over a range of initial magnetic gap lengths.

Figure 10:
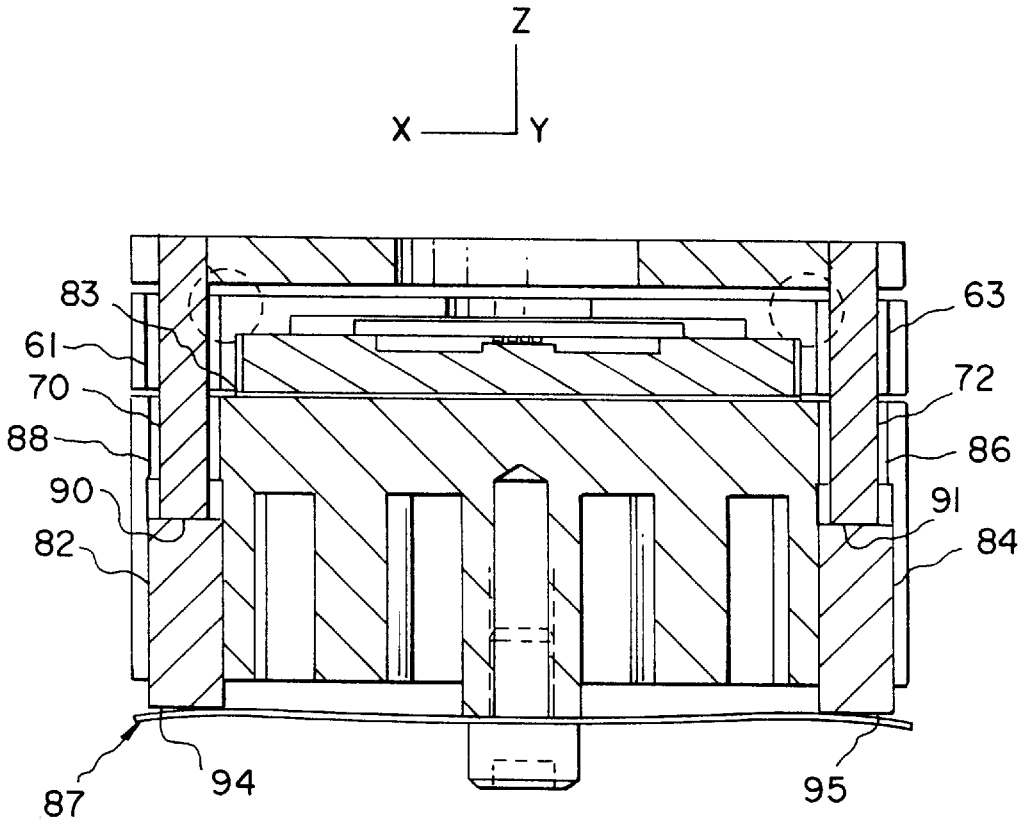
FIG. 10 shows the flexure spring magnetically coupled in a closed magnetic circuit, and the design features which enhance the attraction forces in the system.

Referring to FIGS. 5 and 10, actual operation begins with retainer assembly 33 attached to LED assembly 32 with thermal tape 83. Magnets 82 and 84 are each attracted to, and attach with, flexure 87 which limits their bore travel. Each of the two magnets are free to move from its rest position within its clearance bore, but must do so against an opposing force as exerted by the flexure member. As the combined LED and retainer assembly is installer-coupled with the stationary slotted-plate assembly, pins 70 and 72 enter clearance holes 61 and 63 in the 3-ball platform, and pass into mutually aligned clearance bores 86 and 88 in the retainer assembly. As the gap between top of pin 91 and nearest surface of magnet 84 gets smaller, attractive forces between pin and magnet overcome opposing flexure forces, resulting in a positive coupling of pin and magnet. Just as the unit deliberately and positively couples, net forces in the opposite direction intended for an uncoupling operation do not occur until a certain equilibrium threshold has been reached. This results in a similar and decisive de-coupling. Both the coupling and de-coupling provide a beneficial tactile feedback to the installation operator in an otherwise blind attachment operation, allowing the operator to know that the operation is complete.

Flexure 87 is slightly curved at its ends to provide an enhanced-width line of contact with magnet faces 94 and 95. The cylindrical clearance bores containing the magnets serve to orient the magnet faces normal to the pin faces 90 and 91. As the flexure is deflected over its range, the true position of magnets 82 and 84 is maintained by the clearance bore structure, but relative movement occurs between the magnet faces and the flexure surface. The flexure curve is calculated to be normal to the magnet face at the point of tangency contact, regardless of the included contact angle. The flexure is further designed to maximize magnetic flux transfer by having rounded plan view ends, resulting in reduced flux radiation losses. Magnets are of a NdFeB bonded material, and are capable of retaining a high degree of coercive force under repeated usage applications.

Figure 11A:
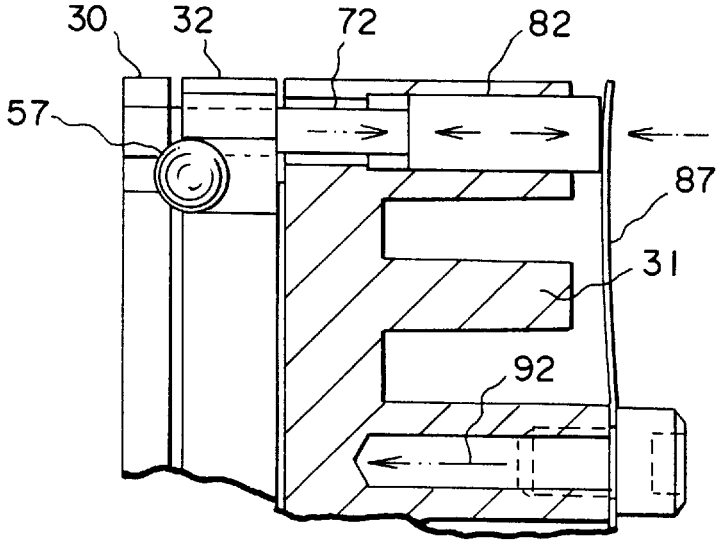
FIGS. 11A–11C are schematic diagrams of the vector forces applied by the magnetic holding feature of the retainer assembly, showing that the forces are organized to exactly constrain the LED assembly in a unique and singular position with relation to the slotted-plate assembly.

Referring to FIG. 11A, a freebody diagram details the magnetic and flexural forces which combine to provide the tactile attachment and retaining features. The retainer assembly, when magnetically coupled, exerts a force on the rear surface of the LED substrate which is normal to that surface, and parallel to the Z-direction optical axis. Forces directed along this path cause the captured balls in the 3-ball platform to attempt to compress further into the three radial slots 57, 58, and 59.

Figure 11B:
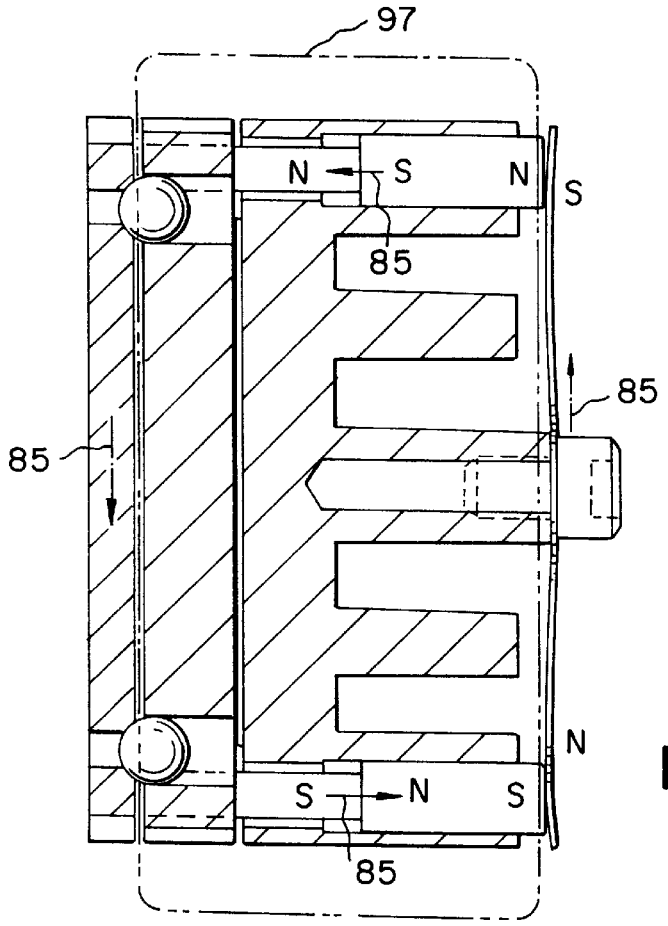

The first force component 92 is a static force, and is cooperatively induced from an interaction of magnetic forces between pins 70 and 72 of the slotted-plate assembly, magnets 82 and 84, retainer assembly 31, and the spring forces induced by flexure 87 attached to each of the two magnets. The magnetic forces are inversely proportional to the gap distance between the magnet faces and the top of the pins, and it thus becomes important to make and maintain contact between each pin surface and magnet face. The flexure is designed to provide a near-constant normal force at the ball/groove interface of LED assembly 32 with projection optics assembly 30 maintaining contact over a set of gap variations which might otherwise cause a magnetic disconnect between pin and magnet. This in turn would result in too much or too little applied force between heatsink and rear surface of printhead. This component of normal force aids in the static locking condition when the LED assembly is first installed, and this same component aids in the relocation of LED assembly to slotted-plate interface in the event of a side force dislocation. The flexure also serves to complete a closed magnetic loop between the series-arranged poles of the two magnets, the pins, and the ferro-magnetic slotted-plate assembly. Referring to FIG. 11B, note the polarity arrangement of N-S-N-S of this induction loop, and the fact that it is a closed loop because of the non-magnetic properties of all other surrounding or contacting materials 97. The existence of this loop 85 serves to strengthen the magnetic attraction forces between the tops of the pins and their magnetic counterparts, thus improving the functional locking capability of the heatsink retainer assembly.

Figure 11C:
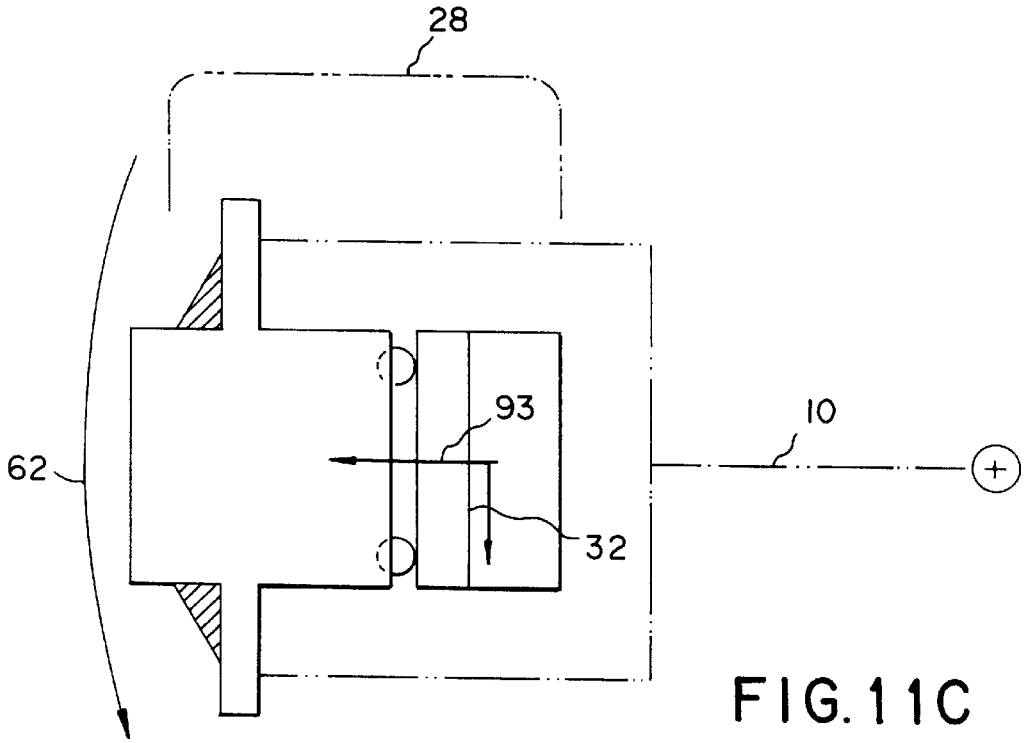

Referring to FIG. 11C, the second component of motive force 93 is rotationally induced from the circular motion of imaging assembly 28 at the end of spinning rotor arm 10. This exerts a normal force on LED assembly 32, which further urges balls 64, 66, and 68 into cooperating projection optics locating slots 57, 58, and 59. The magnitude of this normal force component is several times larger than that of the attractive magnetic coupling, and is a function of the mass of the components comprising the combination of the LED assembly and the retainer assembly. This force serves to further stabilize the LED printhead assembly under dynamic usage conditions.

Just as the positioned LED assembly is insensitive to vertical loading, the 3-ball design is also insensitive to radial and translational creep caused by thermal changes in ambient conditions. The 3-ball platform is non-ferrous, and has a certain coefficient of thermal expansion. The mating slotted-plate is ferrous, having a different coefficient, and thus changes at a different linear rate. If both change isotropically, the result remains as a uniform relative movement between ball feet of 3-ball platform and radial grooves in slotted plate, with the 3-ball platform centroid remaining stationary with respect to the slotted-plate centroid. Remaining stationary implies zero movement, which components include radial, or rotational, motion.

It is to be understood that the alignment mechanism of the present invention has applications in other types of systems where an element within the system must be produced and aligned to a consistent interface datum structure, and all elements of the same system must be held in a cooperatively controlled manner without over-constraint. For example, a pigtail fiber having an aligned laser diode attached to one end, could have an installed datum interface on its opposite end which would position itself to interface with any and all compatible optical systems, and to locate in a highly repeatable exact-constraint mode. Such assemblies could be utilized as field-replaceable assemblies in digital reading or writing applications. Alternately, optical lenses within a multi-element system can be aligned on an individual component basis to a consistent interface datum structure, regardless of individual mechanical or optical property differences. Such lens assembly elements can then be retained to a common structure without over-constraint by using the magnetic keeper element of the invention.

The invention has been described in detail with particular reference to preferred embodiments thereof, but it will be understood that variations and modifications can be effected within the spirit and scope of the invention.

List
Rotor
Counterweight
Rotor support member
Carriage Assembly
Photosensitive Media
Guide Rod
Writing Surface
Guide Rod
Cylindrical support
Inner surface
Lead screw
Stepper motor
Imaging assembly
Projection optics assembly
LED assembly
Retainer assembly
Barrel, threaded barrel
Spacer, mirror spacer
Spacer, mirror spacer
Lower mirror
Upper mirror
Blocking aperture
Exit aperture
Jam nut
Circular recess
Wave washer
Parts List (cont'd)
Slotted-Plate
Locking nut
Rear focal conjugate;
Plane of 3-ball platform
Path;
Plane of slotted-plate
Front focal conjugate;
Radial slot
Radial slot
Radial slot
Openings
Hole, clearance hole (for pin 70)
Tangential Motion
Hole, clearance hole (for pin 72)
Ball
3-ball platform
Ball
Light source module
Ball
Led dies
Pin
Baseplate
Pin
Aperture array plate; quartz array plate
3×4 led matrix pattern
Hole
Flex circuit address leads
Parts list (cont'd)
Hole
Connector
Adhesive agent
finned construction of heat sink
cylindrical magnet
thermal transfer tape
cylindrical magnet
clearance bore (retainer assy)
curved flexure
clearance bore (retainer assy)
flexure surface
pin face
pin face, pin surface
First force component, static force
Second force component, rotationally induced
magnet face
magnet face
Non-magnetic materials

We claim:

1. A printing apparatus having a fixed focal point for a recording medium to which the printing apparatus writes, the apparatus comprising:

(a) a rotor;

(b) an intensity-modulated light source adapted to emit a light beam along an optical path;

(c) a platform having three ball feet which are permanently positioned in the platform so that rotation of the ball feet is prohibited, and to which said platform the light source is fixed for maintaining the positional relationship of said light source in relation to the focal point;

(d) a plate having three grooves attached to the printing apparatus which cooperatively receives the ball feet; and (e) a housing that receives said plate and platform and cooperatively attaches to the rotatable rotor to move the light source for scanning the light beam along the recording medium, for permitting removal and replacement of the light source in a precise fashion.

2. The printing apparatus of claim 1, wherein the plate includes the radially extending grooves.

3. The printing apparatus of claim 2, wherein said ball feet are spherical-shaped ball bearings.

4. The printing apparatus of claim 3, wherein said platform includes three holes for receiving said ball bearings, which said holes are slightly larger than said ball bearings.

5. The printing apparatus of claim 4 further comprising a heat sink and two pins extending perpendicularly from said plate, and said pins further passing through said platform assembly to couple with the heat sink.

6. The printing apparatus of claim 5, wherein said heat sink includes two magnets restrained by a flexural device, which magnets are respectively attracted to said pins.

7. The printing apparatus of claim 6, wherein said plate, pins, magnets, and flexure form a closed magnetic loop for maximizing magnetic attraction forces.

8. The printing apparatus of claim 7, wherein said heat sink is a non-magnetic material, and provides a cavity within which the magnets move against opposing forces of the flexure.

9. The printing apparatus of claim 8, wherein said balls and grooves respond to thermal changes such that rotational and translational relative positions of said platform and said plate remain unchanged.

10. The printing apparatus of claim 9, wherein said platform includes clearance holes for permitting restricted movement of said platform relative to said pins such that said balls move less than half of a ball diameter before restraint by said opposing pins.

11. An imaging assembly comprising:

a) projection optics assembly comprising;

a1) imaging optics; and a2) a slotted plate including three radially extending slots each for receiving one of three balls; and b) an LED assembly comprising:

b1) a baseplate;

b2) LED dies supported by the baseplate and covered by an aperture array plate;

b3) a platform having a center hole and three ball-receiving holes, and b4) three balls received loosely within the three ball-receiving holes, respectively, such that when the balls are permanently positioned in the receiving holes, the balls are aligned with the three radially extending slots of the slotted plate the platform is parallel to the slotted plate, and the optical position of the LED dies as seen through the center hole of the aperture array plate is a constant distance from the surface of the slotted plate.

12. The imaging assembly as set forth in claim 11, wherein: the slotted plate further includes two axially extending pins; and the platform further includes two clearance holes through which the two axially extending pins pass, respectively, to provide a loose restraint for the LED assembly relative to the projection optics assembly, clearance between the pins and sidewalls of the clearance holes being less than half the diameter of the balls so that any ball that is dislodged from its respective slot will be caused to fall back into the respective slot.

13. The imaging assembly as set forth in claim 12, further comprising a retainer assembly having: a heat sink for removing heat from the imaging assembly a pair of magnets for coupling axially extending pins within the retainer assembly; and a flexure contacting the magnets and adapted to provide a force vector which opposes magnetic coupling of the magnets and the flexure.

* * * * *